US006848648B2

(12) United States Patent
Klestadt et al.

(10) Patent No.: US 6,848,648 B2
(45) Date of Patent: Feb. 1, 2005

(54) SINGLE ACTUATOR DIRECT DRIVE ROLL CONTROL

(75) Inventors: Ralph H. Klestadt, Tucson, AZ (US); Robert D. Stratton, Tucson, AZ (US); Christopher P. Owan, Tucson, AZ (US); Laurence F. Prudic, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/374,845

(22) Filed: Feb. 25, 2003

(65) Prior Publication Data

US 2004/0164202 A1 Aug. 26, 2004

(51) Int. Cl.[7] ..... F42B 10/02; F42B 10/00

(52) U.S. Cl. ..... 244/3.23; 244/3.1; 102/501

(58) Field of Search ..... 102/501–529; 244/3.1–3.3

(56) References Cited

U.S. PATENT DOCUMENTS 3,067,681 A 12/1962 Beman
3,262,655 A * 7/1966 Gillespie, Jr. ..... 244/3.1
4,512,537 A * 4/1985 Sebestyen et al. ..... 244/3.21
4,592,525 A * 6/1986 Madderra et al. ..... 244/3.28
5,139,216 A * 8/1992 Larkin ..... 244/3.21
5,164,538 A * 11/1992 McClain, III ..... 102/517
5,393,012 A 2/1995 Dunn
6,360,987 B1 * 3/2002 Sallaee et al. ..... 244/3.21
6,378,801 B1 * 4/2002 Pell et al. ..... 244/3.24
6,646,242 B2 * 11/2003 Berry et al. ..... 244/3.1

FOREIGN PATENT DOCUMENTS

DE 11 41 537 B 12/1962

* cited by examiner

*Primary Examiner*—Bernarr E. Gregory
(74) *Attorney, Agent, or Firm*—Thomas J. Finn; Leonard A. Alkov; Karl A. Vick

(57) ABSTRACT

A system and method for controlling roll in a projectile. The novel system (56) includes first (52) and second (58) sections adapted to counter-rotate relative to each other and a mechanism (76) for inducing the counter-rotation to generate a roll torque on the projectile (50). In the preferred embodiment, the mechanism (76) is a motor comprised of a rotor (64) affixed to the first section (52), and the second section (58) which acts as a stator that rotates around the rotor (64) when a current is applied to the armature. In an alternative embodiment, the second section (58) is turned by a motor (80) attached to the first section (52) which drives a small gear engaging a full-diameter ring gear (82) on the second section (58). In the illustrative examples, the first (52) and second (58) sections are a missile forebody and a tail section of the projectile.

8 Claims, 4 Drawing Sheets

FIG. 1a
(Prior Art)
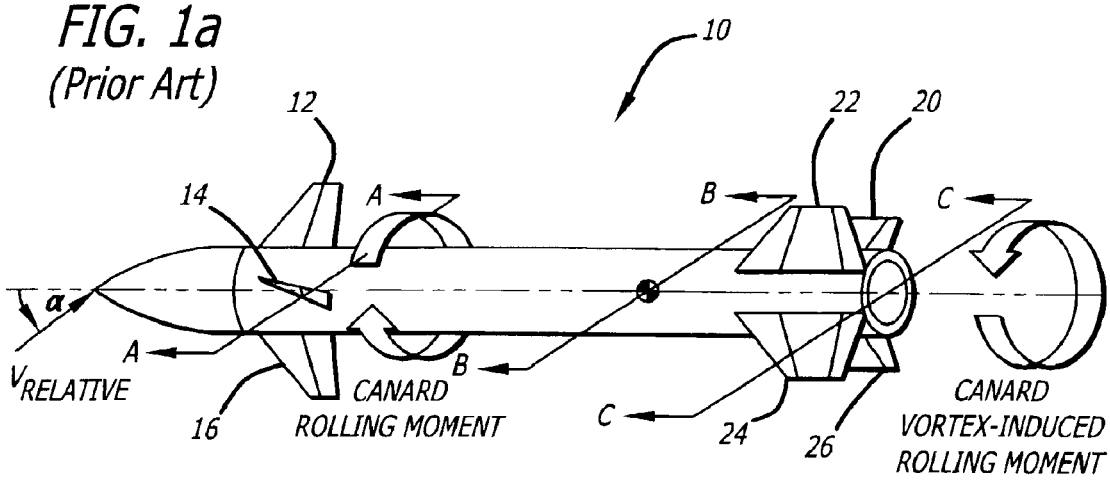
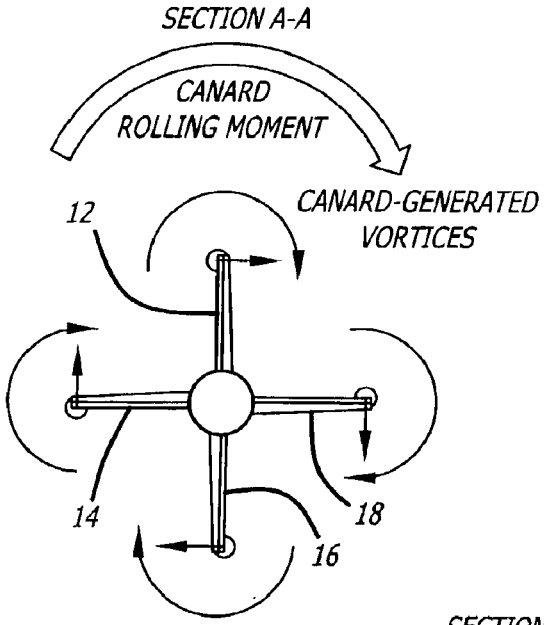
FIG. 1b
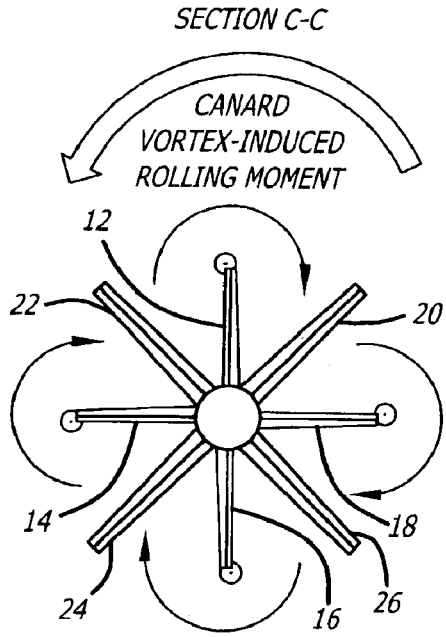
FIG. 1d
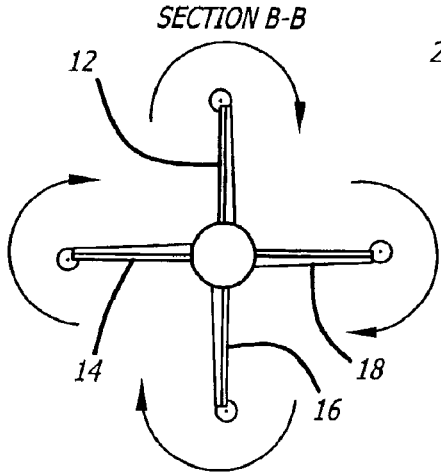
FIG. 1c

SINGLE ACTUATOR DIRECT DRIVE ROLL CONTROL

BACKGROUND OF THE INVENTION

1. Field of the Invention

The present invention relates to missiles. More specifically, the present invention relates to roll control in canard-controlled missiles.

2. Description of the Related Art

Future concepts for highly maneuverable missiles require active control of body roll. This has traditionally been accomplished with a cruciform arrangement of control surfaces, with four separate actuator motors moving the fins to achieve control through application of aerodynamic forces. Active control of roll has been largely limited to tail-control airframes, which have a restricted volume in the area around the rocket motor nozzle to package actuators. Tail control airframes are less desirable for high maneuverability applications, since they have significant limitations in their speed of response by virtue of the tails being behind the center of gravity. The rapid maneuver response of canard-controlled airframes, a result of locating the control surfaces forward of the center of gravity is more desirable for high maneuver applications; however, roll control via canards has seen limited exploitation because of well-known canard-tail interaction problems.

Roll control in a canard-controlled airframe has been attempted in two ways. The first approach allows the tail assembly to freely roll on a bearing. The tails can exert pitch and yaw forces, but adverse roll from the canard downwash is eliminated by virtue of the roll bearing. Allowing the tail to freely roll eliminates roll coupling, but causes problems in hysteresis and stability. Hysteresis occurs when the tail stops rolling depending on how a particular flight condition was reached. The resulting stability is therefore flight condition path dependent. In addition, as the tail rolls, the aerodynamic effectiveness of the surfaces changes, so the stability shifts according to the tail roll rate. These effects complicate autopilot design and cause restrictive bounds to be put on lateral g capability, limiting the maximum maneuver capability of the system. The second approach to decouple canard pitch control from tail roll effects is to put separate actuators in the tail section, allowing them to command tail deflections and overpower the canard downwash effects. This approach requires packaging of conventional actuator motors in the aft end of the missile. In addition, the tail surfaces are rotated in a conventional manner, with associated free play and gear train complexity for each fin. Furthermore, the size of fins designed for roll control will differ from that designed for pitch and yaw stability, resulting in a less than optimal compromise which ultimately means less maneuverability.

Hence, a need exists in the art for an improved system or method for controlling body roll in canard-controlled airframes which offers greater performance potential than has been achieved by the prior art.

SUMMARY OF THE INVENTION

The need in the art is addressed by the system and method for controlling roll in a projectile of the present invention. The invention includes first and second sections adapted to counter-rotate relative to each other and a mechanism for inducing the counter-rotation to generate a roll torque on the projectile. In the preferred embodiment, the mechanism is a motor comprised of a rotor affixed to the first section, and the second section which acts as a stator that rotates around the rotor when a current is applied to the armature. In an alternative embodiment, the second section is turned by a motor attached to the first section which drives a small gear engaging a full-diameter ring gear on the second section. In the illustrative examples, the first and second sections are a missile forebody and a tail section of the projectile.

BRIEF DESCRIPTION OF THE DRAWINGS

FIG. 1*a* is an illustration of a conventional canard controlled missile showing the difficulty with which roll control is achieved.

FIG. 1*b* shows a cross-section of the missile of FIG. 1*a* just behind the canards.

FIG. 1*c* shows a cross-section of the middle of FIG. 1*a* of the missile.

FIG. 1*d* shows a cross-section of the missile of FIG. 1*a* just behind the tail.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

FIG. 1*a* is an illustration of a conventional canard controlled missile showing the difficulty with which roll control is achieved. FIG. 1*b* shows a cross-section of the missile just behind the canards. FIG. 1*c* shows a cross-section of the middle of the missile. FIG. 1*d* shows a cross-section of the missile just behind the tail. The missile 10 has four canards (12, 14, 16, 18—not shown) near the front of the missile and four tail fins (20, 22, 24, 26). When canards are deflected differentially (side-to-side) to generate a roll command, the effect of this downstream on the tails is opposite to what is commanded. As shown in FIGS. 1*b*–1*d*, deflecting the canards (12, 14, 16, 18) to create a clockwise torque generates aerodynamic vortices which have an undesirable effect on the tails, inducing a counter-clockwise torque in opposition to the clockwise torque created by the canards. This "roll reversal" is well known, and causes complication with autopilot design and limitations to be placed on the maximum maneuver capability of the system.

Figure 2:
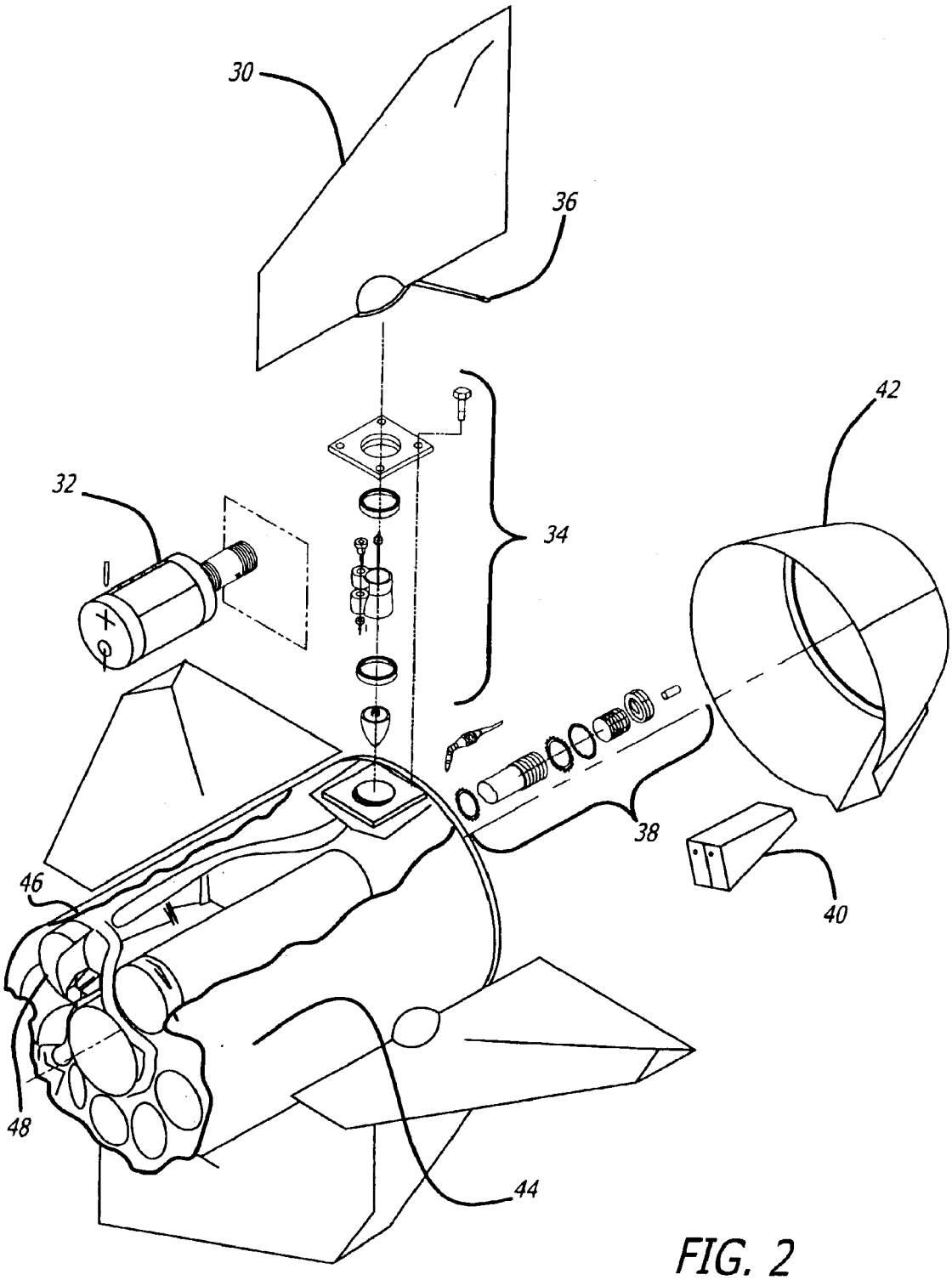
FIG. 2 (Prior Art)
FIG. 2 is an illustration of a typical actuator arrangement of a conventional tail control missile

FIG. 2 is an illustration of a typical actuator arrangement of a conventional tail control missile, with four separate aerodynamic surfaces 30 and electrical motors 32 controlling each. The significant volume requirement for the four motors 32 is indicated, along with the associated gear train 34 and bearings for each control surface 30. Also shown are the control surface quick attach lever 36, driveshaft lock assembly 38, data link 40, boattail 42, control section skin 44, actuator housing 46, and battery 48.

Figure 3:
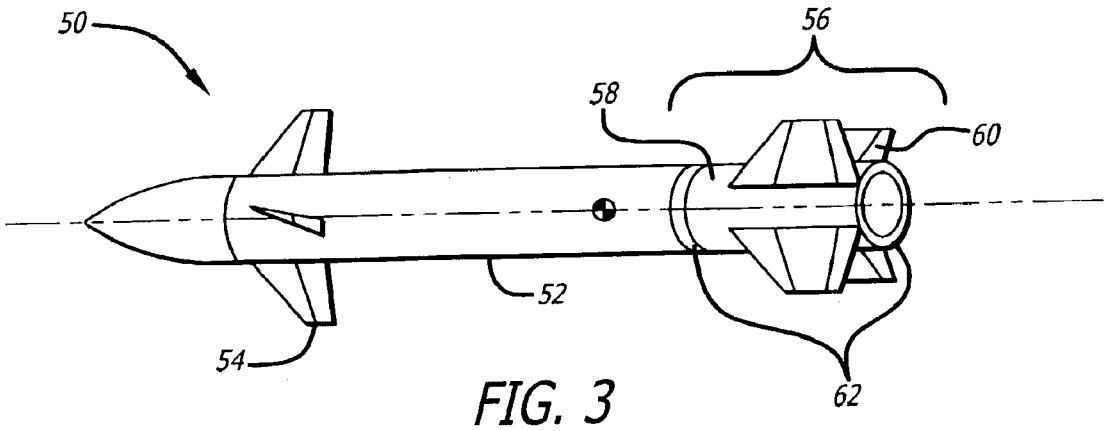
FIG. 3 is an illustration of an illustrative embodiment of the present invention incorporated in a representative missile.

FIG. 3 is an illustration of an illustrative embodiment of the present invention incorporated in a representative missile 50. Illustrated are the missile forebody 52, which contains the forward pitch/yaw control canards 54 as part of a guidance section, a payload, a rocket motor, and the roll control section 56, which includes a stator and fin assembly 58 with four fins 60 attached to the missile forebody 52 by two bearings 62.

Figure 4:
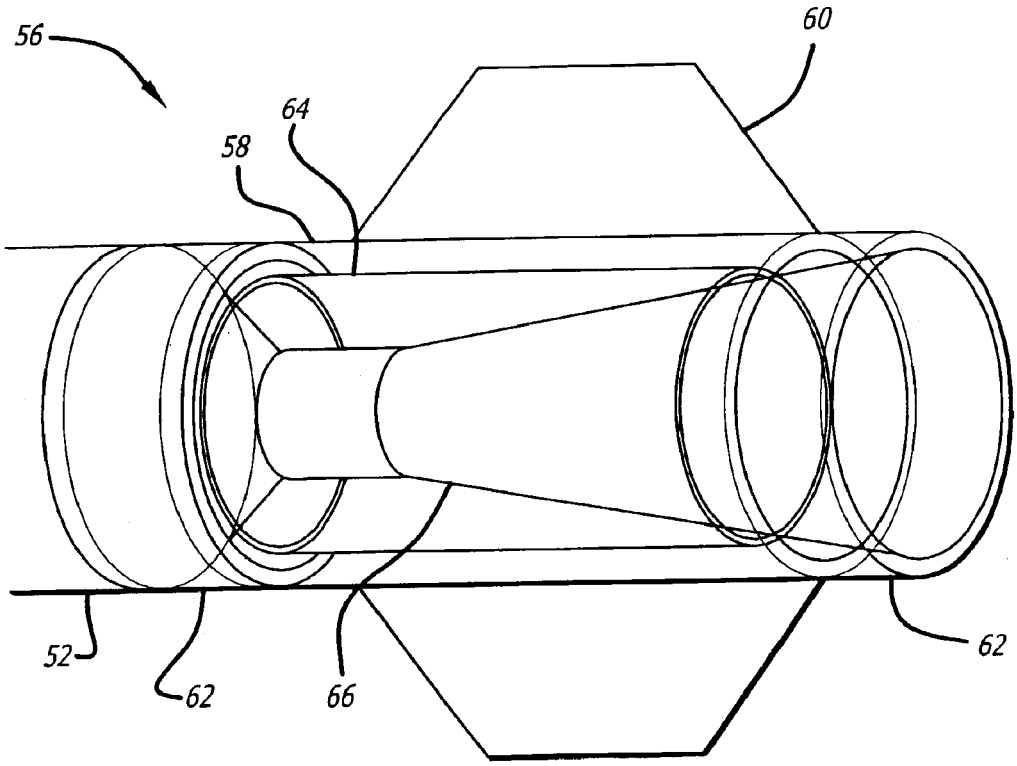
FIG. 4 shows the roll control device of the present invention in greater detail.

FIG. 4 shows the roll control device 56 in greater detail. The roll control device 56 is directly analogous to a conventional electric motor, and consists of a rotor 64 wrapped around and affixed to the rocket motor throat/nozzle 66 assembly. Unlike a conventional motor, in this application the rotor 64 stays fixed (relative to the missile body). Around the rotor 64 is the stator 58, which again unlike a conventional motor, rotates. This arrangement is commonly known as an "inside-out" motor. The stator exterior surface forms the outer surface of the missile body in the fin area, and has the fins 60 rigidly attached to it. The stator 58 can be attached to the missile structure 52 by conventional bearing assemblies 62, as indicated in the figure. Pitch and yaw forces are translated through the bearings 62 unaffected by the roll control forces of the motor.

Applying current to the armature results in the stator 58 turning around the rotor 64 identical to a conventional electric motor. The roll rate of the tails is a function of the current applied to the motor. The resulting forces induced on the tails due to the rotational velocity is a result of natural aerodynamic damping, and is proportional to the speed at which the tails are rotating and the forward velocity of the missile. This force is defined by the classical roll damping equation:

$$L_P = C_{LP}(pD_{ref}/2V)(q\ S_{ref}D_{ref}) \quad [1]$$

where:

$L_P$=roll torque due to roll rate $C_{LP}$=aerodynamic roll damping coefficient p=angular roll rate of stator $D_{ref}$=reference diameter V=freestream velocity q=dynamic pressure $S_{ref}$=reference area In addition, there will be a roll torque which is proportional to the angular acceleration imparted to the tails, analogous to a momentum wheel in a satellite control system. This force is defined by:

$$L_A = \partial(\mathbf{1}w)/\partial t \quad [2]$$

where:

$L_A$=torque due to acceleration of the stator/fin assembly

I=rotational inertia of stator/fin assembly w=angular roll rate of stator relative to rotor There will also be a smaller term due to inertial damping, which must be modeled but likely can be neglected for a first-order design analysis.

In operation, the device would allow control of both steady-state and instantaneous roll torques. To maintain a continuous roll rate, the tail would be rolled at a roll rate which is a function primarily of missile velocity. To generate instantaneous corrections to account for aerodynamic disturbances, the tail would be accelerated or decelerated as needed to generate the correct restoring torque.

In order to generate roll torque, a current is applied to the motor by a conventional closed-loop autopilot, as is currently used in many missile applications. The resulting roll acceleration and rate imposes a torque as described above, which is reacted back through the motor into the airframe. This type of control system is analogous to the classical aerodynamic hinge moment torque-feedback control system used in early guided missiles, and is known for its simplicity of design and linearity of control.

Figure 5:
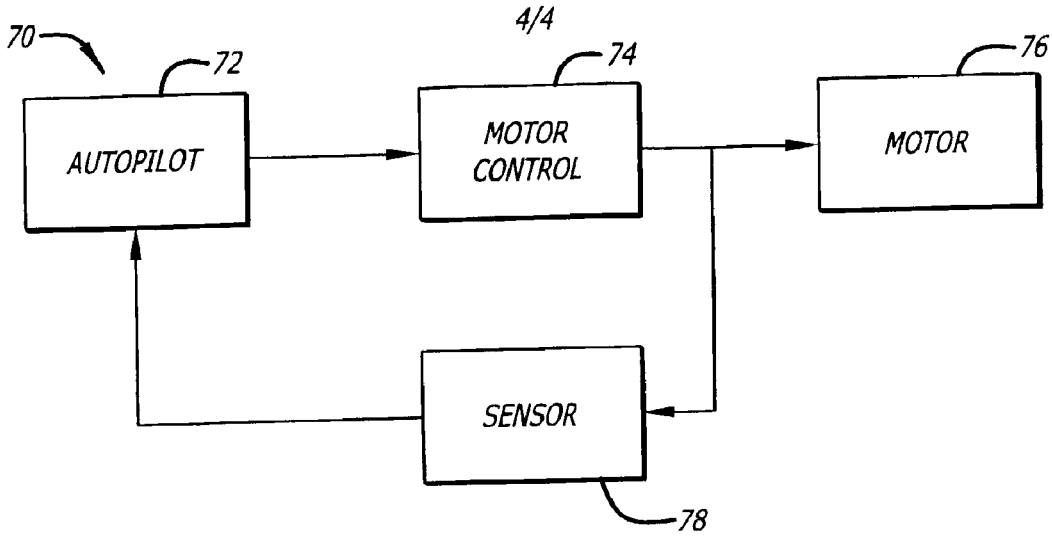
FIG. 5 is a block diagram of a control system for the present invention.

FIG. 5 is a block diagram of a control system 70 for the present invention. An autopilot 72 sends a signal to a motor control 74 indicating the roll torque desired. The motor control 74 calculates (or looks up in a table) the amount of current required to generate that torque and adjusts the current to the motor 76 accordingly. The torque is measured by a sensor 78 by measuring the current. The measured torque is then fed back to the autopilot 72.

The motor control loop is—by measuring the current—measuring the force which is of primary interest (torque into body), unlike conventional aero force control. With the prior art, motors are used to deflect the fins, generating a force on the fins which creates a torque around the longitudinal axis of the missile (the roll torque). This roll torque needs to be constantly sensed. The method of the present invention removes the aerodynamics from the equation. The current to the motor is a direct measure of the roll torque.

Figure 6:
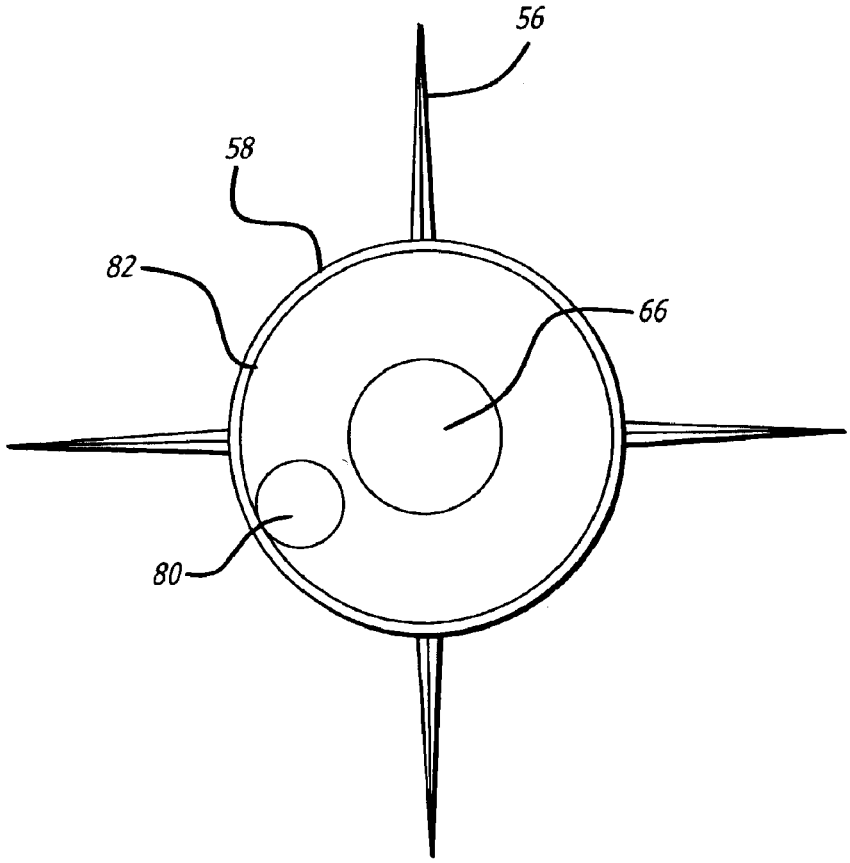
FIG. 6 is an illustration of an alternative embodiment of the present invention.

An alternate, more conventional embodiment of the present invention is also possible and is illustrated in FIG. 6. FIG. 6 is an illustration of an alternative embodiment of the present invention. This would include a typical small actuator motor 80 as indicated in FIG. 2, whose outer case would be attached to the rocket motor and/or throat/nozzle assembly 66. This motor 80 would drive a small gear, which would engage a full-diameter ring gear 82 on the stator assembly 58. This ring gear would allow the stator 58 to be rotated in a manner similar to the above concept, but does not rely on the full-diameter motor implementation. The control mechanisms of roll damping and angular momentum change remain unchanged. The advantages of this system over the full diameter motor is that it can be adapted to use existing motor designs with little risk. The disadvantage of this system is that the use of gears has introduced free play and torque/rate amplification considerations into the design of the system, complicating the control loop implementation.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A system for controlling roll in a projectile comprising:

first and second sections adapted to counter-rotate relative to each other and first means including a motor for inducing said counter-rotation to generate a roll torque on the projectile, said motor being comprised of a rotor affixed to said first section and said second section, said second section adapted to act as a stator adapted to rotate around said rotor, said first means further including means for applying current to said motor to rotate the stator relative to the rotor, generating a roll torque on the projectile.

2. The invention of claim 1 wherein said first and second sections are a forebody and a tail sections, respectively.

3. The invention of claim 1 wherein said second section is attached to said first section by two bearing assemblies at either end of said second section.

4. The invention of claim 1 wherein said motor is attached to said first section.

5. A system for controlling roll in a projectile comprising:

first and second sections adapted to counter-rotate relative to each other and first means including a motor for inducing said counter-rotation to generate a roll torque on the projectile, said motor being comprised of a rotor affixed to said first section and said second section, said second section adapted to act as a stator adapted to rotate around said rotor, wherein said rotor is wrapped around and affixed to the rocket motor throat/nozzle assembly of the projectile.

6. A system for controlling roll in a projectile comprising:

first and second sections adapted to counter-rotate relative to each other and first means including a motor for inducing said counter-rotation to generate a roll torque on the projectile, wherein said motor is attached to the rocket motor or a throat/nozzle assembly of said projectile.

7. A system for controlling roll in a projectile comprising:

first and second sections adapted to counter-rotate relative to each other and first means including a motor for inducing said counter-rotation to generate a roll torque on the projectile, wherein said motor is attached to said first section and drives a gear which engages a full-diameter ring gear on said second section.

8. A method for controlling roll in a projectile comprising the steps of:

adapting first and second sections of said projectile to counter-rotate relative to each other and inducing said counter-rotation with a motor to generate a roll torque on the projectile, said motor being comprised of a rotor affixed to said fisrt section and said second section, said second section adapted to act as a stator adapted to rotate around said rotor, said step of inducing further including the step of applying current to said motor to rotate the stator relative to the rotor, generating a roll torque on the projectile.

* * * * *